United States Patent [19]

Briere

[11] Patent Number: 4,628,227

[45] Date of Patent: Dec. 9, 1986

[54] MICA-ELECTRODE LAMINATIONS FOR THE GENERATION OF IONS IN AIR

[75] Inventor: Richard L. Briere, Hopkinton, Mass.

[73] Assignee: Dennison Manufacturing Company, Framingham, Mass.

[21] Appl. No.: 479,547

[22] Filed: Mar. 28, 1983

Related U.S. Application Data

[63] Continuation-in-part of Ser. No. 194,649, Oct. 6, 1980, Pat. No. 4,381,327.

[51] Int. Cl.[4] ..... H01J 7/24; H05B 31/26

[52] U.S. Cl. ..... 315/111.81; 346/159; 250/426; 315/111.41; 428/363

[58] Field of Search ..... 315/111.81, 111.31, 315/111.41, 111.51, 169.4; 428/363, 137; 346/159; 250/426

[56] References Cited

U.S. PATENT DOCUMENTS

| | | | |
|---|---|---|---|
| 3,026,222 | 3/1962 | Rogers, Jr. et al. | 428/324 |
| 3,618,753 | 11/1971 | Glasspoole | 428/363 |
| 4,155,093 | 5/1979 | Fotland et al. | 315/111.81 |
| 4,156,165 | 5/1979 | Fischer | 315/169.4 |
| 4,160,257 | 7/1979 | Carrish | 315/169.4 |
| 4,185,230 | 1/1980 | Walters | 315/169.4 |
| 4,322,659 | 3/1982 | DeJule et al. | 315/169.4 |
| 4,381,327 | 4/1983 | Briere | 428/137 |
| 4,409,604 | 10/1983 | Fotland | 315/111.81 |

*Primary Examiner*—Saxfield Chatmon
*Attorney, Agent, or Firm*—George E. Kersey

[57] ABSTRACT

A method for fabricating laminations of mica and conductive foils of particular utility in constructing apparatus for generating ions in air. A layer of mica is laminated to sheets of metallic foil using a thermoplastic adhesive. The foil is etched in order to form electrodes in a prescribed pattern. The mica-foil laminate may be appended to additional structures to interface actuating electronics, provide a heat sink, and for other purposes. The preferred bonding material is a thin film of thermoplastic organopolysiloxane adhesive.

18 Claims, 7 Drawing Figures

MICA-ELECTRODE LAMINATIONS FOR THE GENERATION OF IONS IN AIR

BACKGROUND OF THE INVENTION

The present application is a continuation-in-part of U.S. application Ser. No. 194,649, filed Oct. 6, 1980, now U.S. Pat. No. 4,381,327.

The present invention relates to the fabrication of laminations of mica and conductive materials, and in particular to the manufacture of ion generating apparatus incorporating such laminations.

Mica has long been known by those skilled in the art to be a suitable dielectric material for use in many different applications. Mica possesses superior dielectric properties, including a high dielectric constant and good dielectric strength. As a stable, inorganic material mica resists eroding by a number of different substances. Mica may be easily fabricated in thin, uniform dielectric layers with thicknesses of 1 mil and less. When fabricated in these thicknesses, mica is an extremely sturdy, durable material.

A particularly common application for mica is as the dielectric component of capacitors. Mica capacitors are normally constructed by "silvering"—that is by printing electrodes onto blades of mica, usually by means of a silk screen process. The silver is applied to the mica in a solution, and the solvent evaporated by firing the composite in an oven. This fabrication technique provides a good connection between mica and electrode, and allows a compact design by avoiding thick blades or foils. Because of the delicate nature of the electrodes created with this process, it is necessary to completely encapsulate the mica-electrode laminate to protect the electrodes from environmental influences.

In certain utilizations, however, it is necessary to directly expose the mica dielectric and electrode material to air. One such utilization is shown in commonly assigned U.S. Pat. No. 4,155,093, which discloses apparatus for generating ions in air. With reference to the prior art sectional view of FIG. 1, the ion generator 10 comprises two conducting electrodes 12 and 13 separated by a dielectric layer 11. When a high frequency electrical field is supplied between these electrodes by source 14, a pool of negative and positive ions is generated in the areas of proximity of the apertured electrode 13 and the surface of the mica. Thus, in FIG. 1, an air gap breakdown occurs relative to a region 11-*r* of dielectric 11, creating an ion pool in hole 13-*h* which is formed in electrode 13. This is attributable to an atmospheric "glow discharge", which may be contrasted to the more common "arc discharge" in the lower density of excited atoms, and hence lower currents. An advantageous design of a glow discharge ion generator, such as that of the present invention, produces a high percentage of usable ions and hence surprisingly high ion output current densities.

Ions generated by the device 10 of FIG. 1 may be used, for example, to create an electrostatic latent image on a dielectric member 100 with a conducting backing 105. When a switch 18 is switched to position X and grounded as shown, the electrode 105 is also at ground potential and little or no electric field is present in the region between the ion generator 10 and the dielectric member 100. However, when switch 18 is switched to position Y, at which the potential of the source 17 is applied to the electrode 13, this provides an electric field between the ion reservoir 13-*h* and the counterelectrode of dielectric member 100. Ions of a given polarity (in the generator of FIG. 1, negative ions) are extracted from the air gap breakdown region and charge the surface of the dielectric member 100. The rate of charging the dielectric surface may be expressed as a given ion current. Although this patent discloses the geometry of applicant's preferred embodiment, it does not disclose the use of mica for the dielectric 11, nor a method of fabricating such an ion generator.

FIG. 2 gives a sectional view of a three-electrode version 10' of the ion generator of FIG. 1, of a type generally described in U.S. Pat. No. 4,160,257, commonly assigned with the present application. In addition to the elements already described, ion generator 10' includes a "screen" electrode 52 which is separated from electrode 13 by a dielectric spacer 51. Screen electrode 52 includes an aperture 53 which is aligned with the aperture 13-*h*. Dielectric spacer layer 51 is apertured at 55 to permit extraction of ions; aperture 55 is desirably considerably wider than aperture 13-*h* to avoid wall charging effects. The screen electrode 52 is subjected to a potential 54 which influences the extraction of ions from aperture 13-*h*. As explained in U.S. Pat. No. 4,160,257, the screen potential 54 isolates any potential on the dielectric surface 100 from the ion generator, thereby preventing accidental image erasure. The screen electrode furthermore provides an electrostatic lensing effect which may be used to control the size and shape of the latent electrostatic image created on dielectric 100.

The ion generators shown in FIGS. 1 and 2 require exposure of the dielectric 11 and the apertured electrode 13 to air. In employing mica as the dielectric, it has been found that laminates fabricated by silvering the electrodes are unable to withstand the incursion of materials, such as ozone and nitric acids, which are produced as normal byproducts of the ion generation process. On the other hand, traditional methods of laminating thicker layers of conducting foils, such as bonding the layers with thermoset adhesives, present the problem that mica is easily delaminated, i.e. cleaved into layers. This might happen at elevated temperatures, or due to the presence of atmospheric moisture.

Although known encapsulation techniques for mica capacitors protect against delamination due to moisture, these techniques are unsuitable for applications which require exposure to air of the conductive material as well as the dielectric. The construction of an externally exposed mica-foil laminate by traditional methods will result in a structure which will tend to deteriorate easily and have only a very short service life. A laminate of the type illustrated in FIGS. 1 and 2 must withstand high peak voltage radio frequency signals, on the order of kilovolts. It is furthermore necessary that this laminate withstand elevated temperatures characteristic of such high voltage RF potentials. Applicant has discovered that the use of thermoplastic adhesive layers 33, 37 (FIG. 2) to bond the various layers of ion generator 10' meets these various criteria.

A June, 1975 article by William J. O'Malley in *Adhesives Age* magazine, "Silicone Pressure-Sensitive Adhesives for Flexible Printed Circuits", discloses a technique for fabricating flexible printed circuit boards using organopolysiloxane pressure sensitive adhesives. Silicone pressure sensitive adhesives are recommended for this application due to their chemical properties, stability at elevated temperatures, flexibility, and high bonding strength over a broad temperature range. The adhesives also resist heat applied at high relative humidities. This reference does not contemplate the use of extremely thin adhesive layers, however, and in fact indicates unacceptably low peel strength for layers less than 1 mil thick. The laminates disclosed by O'Malley are not well suited to the design of atmospheric ion generators, in that they would provide unacceptably low ion output current densities.

Accordingly, it is a principal object of the invention to provide a method of fabricating durable mica-electrode laminates. A related object is that the laminates of the invention resist delamination due to moisture, and erosion due to ozone, nitric acid, and other substances. The laminates of the invention should be suitable for the generation of ions in air.

Another object of the invention is the achievement of a mica-conductor laminate which exposes the various layers to air. A related object is the avoidance of delamination due to atmospheric moisture and other environmental substances.

Yet another object of the invention is the fabrication of a mica-electrode laminate which is physically stable over a wide range of temperatures. A related object is the achievement of an ion generator which can carry high peak voltage RF signals over a long service life.

A further object of the invention is the fabrication of ion generators which provide satisfactory ion output currents without requiring high drive voltages. A related object is the achievement of an efficient, economical ion generator. It is furthermore desirable to maintain reliable ion current outputs at a plurality of ion generation sites, over the service life of the ion generator.

SUMMARY OF THE INVENTION

In furthering the above and related objects the invention provides a method for fabricating laminations of mica and conductive materials, which are used in constructing apparatus for generating ions in air. The laminations of the invention include a sheet of mica, one or more metallic sheets, and bonding layers of thermoplastic adhesive. In the preferred embodiment of the invention, these bonding layers are comprised of thin films of thermoplastic organopolysiloxane adhesives. The metallic sheets are advantageously etched to form electrodes on one or both faces of the mica sheet. In the preferred embodiment these laminations form the core structure of ion emitting devices of the type disclosed in commonly assigned U.S. Pat. Nos. 4,155,093, and 4,160,157.

In accordance with one aspect of the invention, sheets of mica and conductive material such as foil are bonded together by thin films of thermoplastic adhesive. Advantageously, such adhesives are pressure sensitive in nature. Suitable chemical types include silicon-based and acrylic-based adhesives. An especially preferred class of adhesives are thermoplastic organopolysiloxane pressure sensitive adhesives. The adhesive film advantageously has a thickness in the range $0.5\mu$–$5\mu$, with the lower end of the range being preferred.

In the preferred embodiment of the invention, the bonding material is selected from the class of thermoplastic organopolysiloxane adhesives; i.e. which are relatively plastic at temperatures up to 100° C., and above. It is especially preferred to employ materials which have a pressure sensitive adhesive characteristic at ambient temperatures. Suitable, commercially available adhesives include various alkyl aryl polysiloxanes, and especially methyl phenyl and methyl polysiloxanes. In a particular embodiment, a dimethyl diphenyl polysiloxane, or dimethyl polysiloxane, is copolymerized with an MQ resin. Advantageously, the resulting formulation is catalyzed with a peroxide catalyst; illustratively an aryl peroxide such as benzoyl peroxide or 2.4 dichlorobenzoyl peroxide.

In an alternative embodiment of the invention, the bonding material comprises an acrylic based adhesive including a polymer selected from the group consisting of acrylic acid, acrylic esters, and acrylamides. In the preferred version of this embodiment, the adhesive is formed of an ethyl acrylate or 2 ethyl-hexyl acrylate, which may be employed alone, or copolymerized. These acrylic esters may further be copolymerized with vinyl acetate. Another suitable species is polyvinyl acetate. Maleic anhydrides or metal chelates may be added to any of the above acrylic adhesives to achieve enhanced cross-linking.

In accordance with another aspect of the invention, portions of the conductive layer or layers may be selectively removed by etching to create a desired pattern. This method may be used to create electrodes of a given configuration. In the preferred embodiment of the invention, the conductive layer is comprised of a foil of stainless steel, copper, nickel, or other metals which may be etched.

In accordance with a further aspect of the invention, the edges of the mica and conductive layers may be coated with pressure sensitive adhesive for protective purposes. In accordance with a related aspect, the lamination may be dipped in pressure sensitive adhesive to avoid exposing the edges to environmental influences. Such protective measures may be omitted when utilizing a dry film photoresist.

In accordance with yet another aspect of the invention, the mica layer or layers may be fabricated in a thickness range from $2\mu$–$75\mu$, most preferably $10\mu$–$15\mu$. In accordance with a related aspect of the invention, such layer or layers is bonded to a conductive layer or layers having a thickness greater than $6\mu$, preferably around $25\mu$.

In accordance with the preferred embodiment of the invention, a mica-foil lamination is fabricated to create apparatus for generating ions in air. A layer of mica having a thickness around $15\mu$ is bonded at each face to a $25\mu$ thick stainless steel foil, this bonding being accomplished by a layer of organopolysiloxane pressure sensitive adhesive approximately $2\mu$ in thickness. The foil layers are photoetched with matrix electrode patterns on opposite faces of the mica sheet. In the preferred version of this embodiment, the lamination is bonded on one face to a mounting block which acts as a heat sink, and provides structural support. On the opposite face, the electrodes include apertures to provide ion generation sites. The ion generator may further include "screen" electrodes and dielectric spacer layers in accordance with U.S. Pat. No. 4,160,257.

BRIEF DESCRIPTION OF THE DRAWINGS

The above and additional objects of the invention are illustrated in the detailed description which follows, taken in conjunction with the drawings in which.

DETAILED DESCRIPTION

Figure 1:
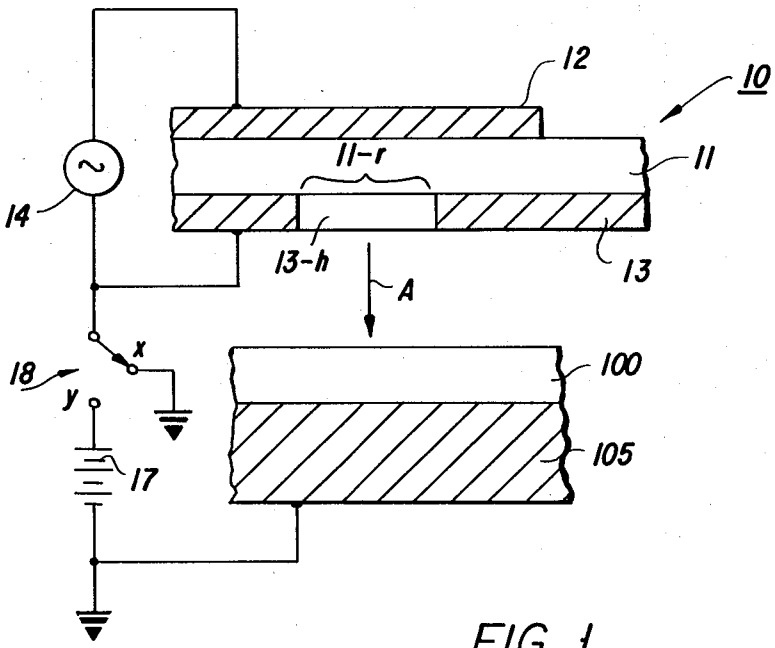
FIG. 1 PRIOR ART
FIG. 1 is a sectional view of a prior art ion generator, disclosed in U.S. Pat. No. 4,155,093.
Figure 2:
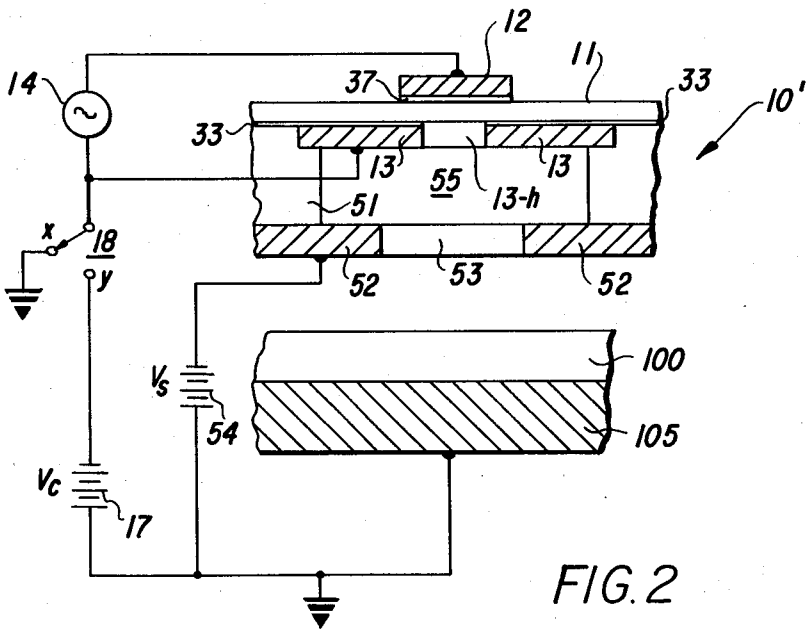
FIG. 2 is a sectional view of an ion generator of the type disclosed in U.S. Pat. No. 4,160,257, fabricated using the method of the present invention.
Figure 3:
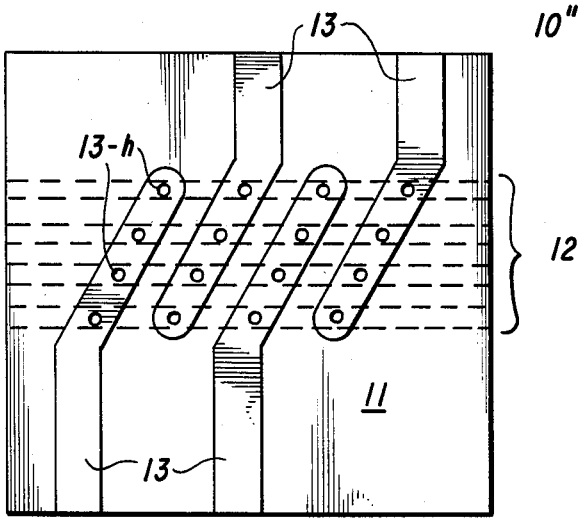
FIG. 3 is a plan view of a multiplexed ion generator of the type shown in FIG. 1.

Reference should now be had to FIGS. 1-6 for a detailed description of the ion generator laminate of the invention. As seen in the sectional view of FIG. 2, an ion generator of the geometry of U.S. Pat. No. 4,160,257 may be fabricated using a layer of mica laminated to thin sheets of metallic foil, by etching the foil to create an array of electrodes on each side of the mica. One such electrode pattern is illustrated at 10″ in the plan view of FIG. 3, showing a series of finger electrodes 13 on one side of a mica sheet 11, and a transverse series of selector bars 12 (seen in phantom) on the other side of the mica sheet. An array of apertures 13-*h* are located in the finger electrodes 13 at the crossover points with selector bars 12. It is a particularly advantageous aspect of the invention that the use of a mica sheet 11 as the dielectric allows the fabrication of an ion generator with uniform ion output current densities at various apertures 13-*h* over the expanse of the dielectric.

Figure 4:
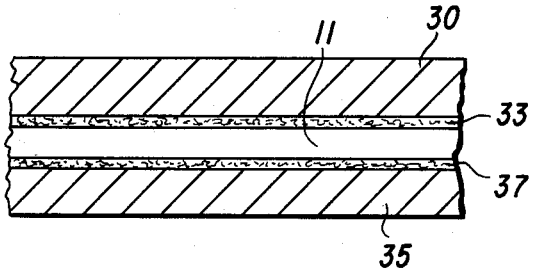
FIG. 4 is a sectional view of a mica-foil lamination in accordance with a preferred embodiment of the invention.

As shown in the sectional view of FIG. 4, a mica sheet 11 of uniform thickness is bonded to two layers of foil 30 and 35. Foil layers 30 and 35 may be etched to form electrodes, as discussed below. The preferred dielectric material is Muscovite mica, $H_2KAl_3(SiO_4)_3$. Muscovite mica, and in particular Ruby mica, is known for its superior dielectric properties, notably a high Q value. For the fabrication of a matrix electrode ion generator 10″ (FIG. 3) several square inches in area, it is preferred to employ film mica, which is split from the best qualities of block mica. It is desirable to have a sheet of uniform thickness in the range from about $2\mu$–$75\mu$, most preferably $10\mu$–$15\mu$. The thinner mica sheets are generally harder to handle and more expensive, while the thicker mica requires higher RF voltages between electrodes 12 and 13 (see FIG. 1). The mica should be free of cracks, fractures, and similar defects. In an alternative embodiment of the invention (not illustrated), the single mica sheet 11 is replaced with a series of side-by-side mica splittings. Care should be taken to provide a series of mica chips of closely matching thicknesses.

The bond between mica sheet 11 and foil layers 30 and 35 (FIG. 4) is achieved by extremely thin layers of thermoplastic adhesive 33 and 37. A wide variety of thermoplastic materials having adhesive bonding properties are suitable for layers 33 and 37. Preferably layers 33 and 37 are composed of a material having pressure sensitive adhesive properties at ambient conditions and good adhesive bonding properties between dissimilar materials, namely mica and metallic foil, which bonding properties are maintained at elevated temperature conditions.

In addition to maintaining good adhesive bonding strength it is desirable that the adhesive layers 33 and 37 exhibit flexibility at elevated operating temperatures. The adhesive should be sufficiently flexible and plastic under these elevated temperatures that the mica does not delaminate upon heating and cooling between ambient temperatures and about 150° F. This is a critical requirement in view of the danger of differential thermal expansion of the mica and foil layers. In the absence of a layer of flexible adhesive to act as a buffer, this might induce a shear force in the mica 11, causing the mica to cleave at a surface layer.

There are a variety of commercially available adhesives which can meet the above requirements over prolonged periods of operation. However, preferred classes of adhesive are silicone-based adhesives, particularly polysiloxanes, and acrylic-based polymer adhesives, particularly those within the acrylic acid or acrylic ester chemical classes.

Polysiloxane adhesives are especially useful in the construction and operation of ion generators such as those of FIGS. 1 and 2, due to the chemical nature of these materials. These adhesives are notably resistant to moisture and chemicals, such as ozone or nitric acid, which may be formed in trace amounts when the dielectric laminate of the invention is subjected to a high voltage alternating potential on the order of kilovolts to generate ions in air. Adhesive layers formed of these classes resist degradation by etching chemicals such as ferric chloride and potassium hydroxide, which are commonly used to strip photoresist from the metallic foil to create electrodes 12, 13, as discussed below. Fluorinated hydrocarbon solvents and developers should be avoided when employing silicone-based adhesives.

A variety of silicone-based adhesives, in particular polysiloxane adhesives, are suitable for the present application. Silicone adhesives selected from the organopolysiloxane class, more specifically alkyl aryl polysiloxanes or alkyl polysiloxanes, are more readily available or more readily synthesized than other polysiloxanes. Suitable materials within these subclasses of organopolysiloxanes include, for example, methyl phenyl polysiloxanes and methyl polysiloxanes. Particularly, dimethyl diphenyl polysiloxane or dimethylpolysiloxane are preferred; adhesives within these subclasses may be used alone or advantageously copolymerized with an MQ resin. The MQ resin is composed of monofunctional and quadrofunctional siloxane units having the generic chemical formula MxQy, where $M=R_3SiO_{\frac{1}{2}}$; $Q=SiO_{4/2}$ and R is an alkyl group—typically a methyl group, although R may also include $C_2$ to $C_4$ alkyl groups, i.e., ethyl, propyl and butyl groups. These siloxane polymers and MQ resins may typically be catalyzed by employing a peroxide catalyst, preferably an aryl peroxide such as 2,4 benzoyl peroxide. The production and composition of these adhesives is generally discussed in U.S. Pat. No. 2,856,356.

A suitable mixture of dimethyl diphenyl polysiloxane gum and MQ resin for use in forming adhesive film layers 33 and 37 is commercially available under the trade name SILGRIP SR 6574 from the General Electric Company of Waterford, N.Y. A suitable mixture of dimethylpolysiloxane gum and MQ resin is commercially available under the trade designation 280 A adhesive from Dow Corning Co. of Midland, Mich. Either of the above mixtures may be polymerized using, for example, an aryl peroxide type catalyst such as one containing 2,4, dichloro benzoyl peroxide, and a phlegmatic agent such as dibutyl phthalate. This catalyst is available under trade name CADOX TDP from Noury Chemical Company, Burt, N.Y. It should be appreciated that the catalyst, while preferred, can be omitted and the polymerization initiated by other means such as radiation (electron beam) curing.

Alternatively, if the adhesive layers 33 and 37 are formed of an acrylic-based adhesive, suitable adhesives include polymers selected from the group acrylic acid, acrylic esters and acrylamide. Preferred acrylic-based adhesives may be formed of acrylic esters such as ethyl acrylate or 2 ethyl-hexyl acrylate. These acrylic esters may be polymerized alone or copolymerized with each other. Additionally either ethyl acrylate or 2 ethyl hexyl acrylate or mixtures thereof may be copolymerized with vinyl acetate to form an adhesive for film layers 33 and 37. A suitable adhesive may also be formed of polyvinyl acetate. The adhesive film layer may also include acrylic acid and/or acrylamide as copolymers with any of the above-mentioned acrylic based polymer formulations. Maleic anhydride or metal chelates may be added to the above acrylic-based polymers to enhance cross linking of the polymer.

An illustrative acrylic-based adhesive composed of an acrylic resin solution containing 2-ethyl-hexyl acrylate is available under the trade name GELVA Multipolymer Solution RA-2102 from Monsanto Chemical Company, St. Louis, Mo. If this latter acrylic resin solution is used, a catalyst is not required. The solution may simply be diluted with additional solvent such as butyl acetate to a viscosity of about 90 centipoise for facilitate even coating of the mica with the solution prior to curing the adhesive by convective heating.

The mica is coated with a pressure sensitive adhesive formulation using any well known technique which permits precise control over the coating thickness. The adhesive layers desirably have extremely thin thicknesses in the range 0.5μ–5μ, most preferably in the range 0.6μ–2.5μ. The thickness may be determined after lamination by subtracting the known thickness of the mica and foil sheets from the total thickness of the laminate. The adhesive may be applied manually, as by brush coating, spraying, and dipping. A preferred method of coating is that of dipping the mica into a bath of pressure sensitive adhesive, followed by withdrawal of the mica at a calibrated speed. Generally, a faster speed of withdrawal results in a thicker pressure sensitive adhesive coating on each side of the mica sheet 11.

Figure 5A:
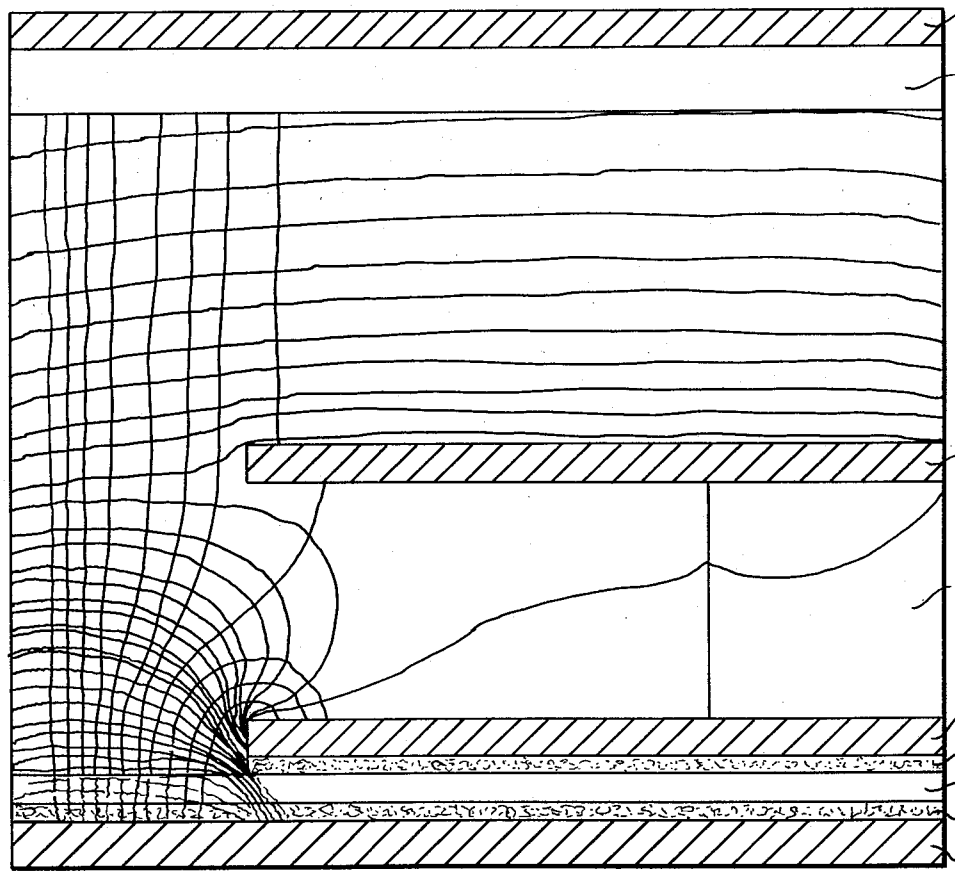
FIG. 5A is a partial schematic sectional view of an actuated ion generator of the type shown in FIG. 2, with a thick layer of adhesive, showing electrical field lines.
Figure 5B:
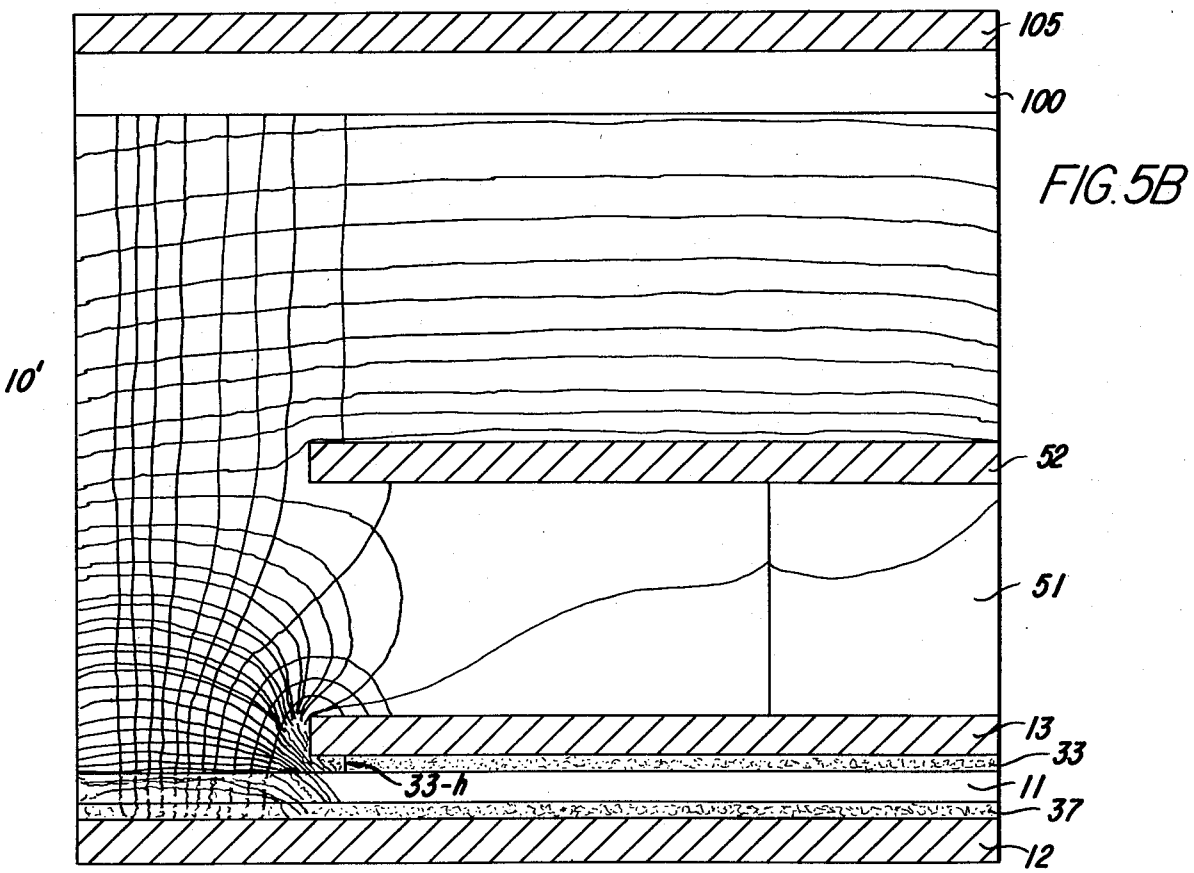
FIG. 5B is a schematic view of the ion generator of FIG. 5A, after extended operation.

The significance of using extremely thin bonding layers is illustrated in FIGS. 5A and 5B, which are schematic sectional diagrams showing an ion generator 10' of the type generally illustrated in FIG. 2. The ion generator 10' illustratively consists of a 25μ thick mica layer 11 having an apertured electrode 13 bonded on one face, and a driver electrode 12 on the other. The bonding material is a 10μ thick layer of pressure sensitive adhesive. FIGS. 5A and 5B show characteristic field lines during electrical actuation of ion generator 10'. A 2600 volt RF signal between electrodes 12 and 13 causes the formation of a pool of positive and negative ions in the aperture **13-*h*. When the control electrode 13 is held at a negative 600 volt potential with respect to ground (i.e. the potential of counterelectrode 105), negative ions are projected from aperture 13-*h* to the dielectric surface 100. The pattern of ion projection and ion current output may be analyzed in terms of the electrical field lines induced by the various imposed potentials, including that caused by the surface charge at 11-*r* within aperture 13-*h*. In order to obtain high ion output currents without requiring unduly large and expensive driving voltages, it is desirable to minimize the diversion of ions from the aperture 13-*h* to locations other than the dielectric 100**.

One of the principal determinants of output currents is the degree to which ions are diverted from aperture **13-*h* to regions adjacent the junction of control electrode 13, adhesive 33, and mica 11. As shown in FIGS. 5A and 5B, wherein the latter represents a later stage of operation of an ion generator 10' with a thick adhesive layer 33, there is a tendency during the continued operation of ion generator 10' to etch away a portion 33-*h* of the adhesive 33 in this region. This is the natural effect of the high temperature, high voltage ion fields found in this area, which will cause the plasma erosion of even relatively durable adhesives such as organopolysiloxane type adhesives. The rate of adhesive undercutting during ion generation and resulting loss of ion current output increases with increasing adhesive film thickness. For this and other reasons, it is especially preferred in the construction of ion generator 10' to employ a bonding layer 33 comprising an extremely thin adhesive film. However, the adhesive film must exhibit sufficient bonding strength and resist delamination of foil layers 30 and 35 even when applied in extremely thin films. In the preferred embodiment, the adhesive film 33** consists of a layer of organopolysiloxane adhesive having a thickness in the range 0.5μ–5μmore preferably 0.6μ–2.5μ.

In the preferred embodiment of the invention, the pressure sensitive adhesive is applied to the mica in solution. The resin may be diluted to a desired viscosity using a variety of solvents, well known to those skilled in the art. In general, higher viscosity formulations will result in a thicker layer of pressure sensitive adhesive for a given method of application. Advantageously, the pressure sensitive adhesive formulation has a viscosity in the range from about 10 cps.–100 cps. The mixture advantageously is filtered prior to coating onto the mica sheet 11.

The coating of mica sheet 11 preferably involves dipping the sheet into the pressure sensitive adhesive bath to completely cover both sides. In lieu of or in addition to a protective coating around the edges of the mica sheet 11, a protective layer of tape may be applied to the edges of the mica-foil lamination. The tape provides protection against migration of moisture between layers of the mica. Alternatively, the tape may be removed after processing of the mica, during which it provides a protective layer, as further discussed herein. Preferably, the tape is coated on one face with pressure sensitive adhesive which may be the same type as used to bond the mica-foil layers.

The foil layers 30 and 35 advantageously comprise a metal which may be etched in a pattern of electrodes 12, 13. Illustrative materials include nickel, copper, tantalum, and titanium; the preferred material, however, is stainless steel. A foil having a thickness from about 6μ–50μ is desirable, with the preferred thickness being around 25μ. The foil sheets 30 and 35 are cut to desired dimensions, and cleaned prior to application to the mica sheet 11. Each sheet is placed in registration with one face of the mica sheet, and then bonded to the mica by applying pressure evenly over the foil layers. In an alternative embodiment, foil sheets 30 and 35 are coated with the bonding material, followed by lamination to mica sheet 11.

In a particular embodiment of the invention, foil sheets 30 and 35 are pretreated by exposure, developing, and etching in patterns which broadly define the outlines of electrode patterns 12 and 13. In this case, the prepatterned foil sheets 30 and 35 are then laminated to the mica 11, and etched in electrode patterns as described below. It is important to carry out the lamination process in a dust-free environment, and then inspect at various stages for dust particles and other foreign matter, which may later create a risk of electrical arcing and otherwise impair performance of ion generator 10'.

After lamination of the foil layers 30 and 35 to mica sheet 11, the foil is selectively removed to create a desired pattern, as for example the pattern of electrodes 12 and 13 shown in FIG. 3. In the preferred embodiment, the desired pattern is created by a photoetching process. This involves coating the foil with a photoresistant material; covering the coated foil with a photomask to create the desired patterns; exposing the masked laminate to ultraviolet radiation; and etching the irradiated foil in order to remove those portions which have been rendered soluble during the preceding steps. The preferred version of this process uses a positive photoresist, which is characterized in that those areas which are exposed to ultraviolet radiation will be rendered soluble and later dissolved.

In the case of solvent-based photoresist, there is a tendency of the solvent to leach out the pressure sensitive adhesive around the edges of the lamination. In addition, the photoresist will not coat well due to edge effects, creating a danger of etch-through. For these reasons, it is advisable to tape the edges to provide a protective layer during these processing steps; the tape may be removed after etching. A water-based material such as AZ-111 positive working photoresist of Shipley Inc., Newton, MA is recommended when employing a liquid photoresist, to avoid softening of the adhesive layers. Alternatively, one may employ a dry film photoresist, which will adequately protect the edges of the lamination if applied in a thickness of around 35$\mu$. Special care should be taken during the etching stage to avoid attacking the mica 11. This entails avoiding unduly high etchant concentration, and employing low to moderate spray pressure when using spray etching apparatus.

It is desirable to seal or pot electrodes 13 in fabricating an ion generator 10 of the type illustrated in FIG. 1, in order to prevent arcing between electrodes. A suitable sealing material is a several mil thick sprayed-on silicone conformal coating. In the event that the outer edges of electrodes 12, 13 extend beyond the edge of mica 11, for example to provide electrical contacts, it is advantageous to provide an insulating support medium adjacent the mica sheet, to act as a platform for electrode contact.

After etching of electrodes 12 and 13, steps should be taken to remove excess adhesive, especially any adhesive located in apertures **13-*h* (FIG. 1). After removal of excess adhesive the lamination may be reheated for additional adhesive curing, and a further coating layer for electrodes 13** may be applied if this material has been attacked during the cleaning step.

Figure 6:
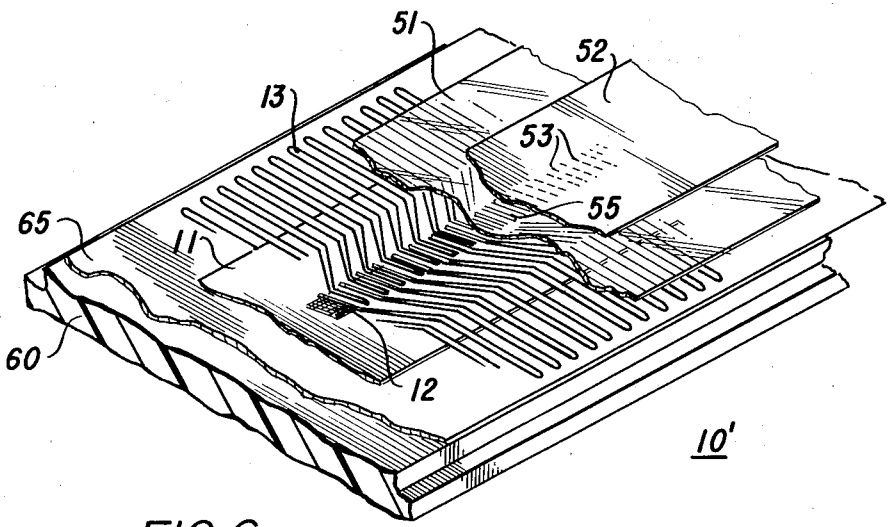
FIG. 6 is a cutaway perspective view of a multiplexable ion generator of the type shown in FIGS. 2 and 3, with laminated heat sink.

In the three electrode embodiment of the invention generally illustrated in FIG. 2, the fabrication process includes additional steps for forming dielectric spacer layer 51 and screen electrode 52. One method of forming dielectric spacer 51 is by screen printing a dielectric material, such as a UV curable material, or silicone layer. As illustrated in the cutaway perspective view of FIG. 6, the screen electrode 52 preferably comprises a layer of foil which has been etched in an array of screen apertures 53 matching apertures **13-*h* of electrode 13. The screen electrode may be bonded to the dielectric spacer layer using, for example, any of the silicone adhesives disclosed above. As illustrated in FIG. 6, the dielectric spacer 51 may comprise a unitary sheet laminated over electrodes 12, including a series of slots 55**.

In the preferred design of an ion generator 10', the mica-electrode laminate is appended to a heat sink 60 (FIG. 6). The heat sink 60 is applied to the lamination face containing selector bars 23 in order to absorb heat resulting from high voltage alternating potentials. A variety of materials are suitable as well known in the art; in the case of electrically conductive materials, an insulating layer 65 should be included to isolate the heat sink from selector bars 23. Such a heat sink also advantageously acts as a mounting block to provide structural rigidity, maintaining ion generator 10 flat in the plane of the mica, which is an important characteristic.

The manufacture of an ion generator in accordance with the invention is further illustrated in the following non-limiting examples:

EXAMPLE I

A mica-electrode lamination of the type illustrated in FIG. 2 was fabricated as follows:

A pressure sensitive adhesive was formulated of 220 parts by weight of a polysiloxane mixture, SILGRIP SR6574 of the General Electric Co., Waterford N.Y., containing dimethyl diphenyl siloxane gum plus MQ resin. The polysiloxane was admixed with 1 part by weight of 2,4 dichlorobenzoyl peroxide catalyst plus 1 part by weight phlegmatic agent dibutyl phthalate; sold under the tradename CADOX TDP by Noury Chemical Co., Burt, N.Y. The mixture was then diluted to a viscosity of about 90 centipoise with butyl acetate solvent. The resulting liquid adhesive formulation was filtered under a pressure of approximately 30 psi and poured into a graduate.

The following steps were then carried out in a dust-free environment. A 1"×9" sheet of ruby Muscovite mica having a thickness in the range 20–25 microns was cleaned using lint-free tissues and methyl ethyl ketone (MEK). After drying, the mica sheet was suspended from a dipping fixture and lowered into the pressure-sensitive adhesive formulation until all but two millimeters was submersed. The mica was then withdrawn from the adhesive bath at a speed of 2 cm/minute, providing a layer of adhesive approximately 3 microns in thickness. The coated mica was stored in a dust-free jar and placed in a 150° C. oven for five minutes in order to cure the pressure-sensitive adhesive.

Two sheets of stainless steel foil 25 microns thick were cut to compatible dimensions and cleaned using MEK and lint-free tissues. One of the sheets was placed in a registration fixture, followed by the coated mica and the second foil sheet. Bonding was effected at room temperature by application of light finger pressure from the middle out to the edges, followed by moderate pressure using a rubber roller. Sheets of Riston 3315 dry film photoresist, E.I. DuPont deNemours & Co., Wilmington Del., were laminated to both foil faces. The laminate was then exposed, developed, and etched to form electrodes 12 and 13, with apertures 13-*h* approximately 0.15 mm in diameter.

Any adhesive remaining on exposed mica surfaces and in electrode apertures was removed using cotton swabs soaked in freon. Selector bars 12 were potted by spraying on successive passes of silicone conformal coating, providing an approximately two mil aggregate thickness, then heated to 75° C. for thirty minutes to cure the silicone.

EXAMPLE II

The mica-electrode lamination of Example I was further processed as set forth below, to provide an ion generator of the type illustrated in FIGS. 2, 6.

The lamination was placed in a mounting fixture with the selector bars 12 upward. The lamination was bonded to a Kapton film 65 (Kapton is a registered trademark of E.I. Dupont de Nemours & Co., Wilmington, DE) to provide an insulating support surface for electrode leads. A stainless steel mounting block of dimensions compatible with the Kapton sheet was prepared for mounting by application of a layer of adhesive resin in accordance with the formulation set forth in Example I, followed by smoothing of the adhesive using a metering blade. The mounting block 60 was clamped in registration with the Kapton film, and any excess adhesive at the edges was removed using cotton swabs. The completed structure was set aside for 24 hours to allow the adhesive to set. Screen electrodes 52 were formed by photoetching a stainless steel foil in a pattern of apertures 53 corresponding to apertures 13-*h* in electrode 13. Two 2.5 mil thick layers of Riston 3315 dry film photoresists were laminated onto the finger electrode face, then developed in a pattern of dielectric spacer layer 51 (FIG. 2), with 15 mil wide slots 55 surrounding each row of finger electrodes 13. The foil layer containing screen electrode 52 was then bonded to spacer layer 51 using the polysiloxane pressure sensitive adhesive of Example I.

The complete ion generator consisted of an array of 16 drive lines and 96 control electrodes which formed a total of 1536 crossover locations capable of placing 1536 latent image dots across a 19.25 cm. wide dielectric surface 100 (FIG. 2). Corresponding to each crossover location was a 0.15 mm diameter etched hole 53 in the screen electrode. Bias potentials of the various electrodes were as follows (with the counterelectrode 105 maintained at ground potential):

screen potential: −600 volts control eletrode: −400 volts (during the application of a −400 volts print pulse, this voltage becomes −700 volts)

driver electrode bias with respect to screen electrode: +300 volts

The DC extraction voltage 17 was supplied by a pulse generator, with a print pulse duration of 10 microseconds. Charging occurred only when there was simultaneously a pulse of negative 400 volts to the fingers 13, and an alternative potential of 2 kilovolts peak-to-peak at a frequency of 1 MHz supplied between the fingers 13 and drive electrodes 12.

Under these conditions it was observed that a 300 volt latent electrostatic image in the form of discrete dots was produced on dielectric surface 100, which was separated by 0.2 mm from the ion generator 10'. Ion output current measurements for apertures 13-*h* averaged around 30–60 nanoamperes after several hours operation. Ion generator 10' provides upward of thirty maintainance-free hours of operation.

EXAMPLE III

A mica-electrode laminate was fabricated as described in Example I, except that an acrylic-based pressure sensitive adhesive was employed. The pressure sensitive adhesive was formulated of an acrylic resin solution available under the trade name GELVA Multipolymer Solution RA2101 containing 2 ethyl-hexyl acrylate, which was diluted to a viscosity of about 50 centipoise using butyl acetate.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. An ion generator comprising:

a mica sheet;

at least one "driver" electrode bonded to a face of said mica sheet;

at least one "control" electrode bonded to an opposite face of said mica sheet; and a time-varying potential applied between said electrodes to form ion-producing glow discharges in an air region in the vicinity of said control electrode and said mica sheet, wherein said electrodes are bonded to said mica sheet with a thermoplastic adhesive of a thickness in the range 0.5 micron–5 microns.

2. An ion generator as defined in claim 1 wherein said thermoplastic adhesive is selected from the class consisting of organopolysiloxane adhesives and acrylic-based pressure sensitive adhesives.

3. An ion generator as defined in claim 2 wherein said thermoplastic adhesive comprises an alkyl aryl polysiloxane adhesive.

4. An ion generator as defined in claim 3 wherein said thermoplastic adhesive is selected from the class consisting of methyl phenyl and methyl polysiloxane adhesives.

5. An ion generator as defined in claim 3 wherein said alky aryl polysiloxane adhesive is copolymerized with an MQ resin.

6. An ion generator as defined in claim 2 wherein said thermoplastic adhesive comprises a polymer selected from the class consisting of acrylics, acrylic acids, acrylic esters, and acrylamides.

7. An ion generator as defined in claim 1 wherein said mica sheet comprises a Muscovite mica film having a thickness in the range 10–25 microns.

8. An ion generator as defined in claim 1 wherein said control and driver electrodes are comprised of etched metal foil.

9. An ion generator as defined in claim 1 wherein the control electrode includes an edge surface forming a junction with the mica sheet adjacent the air region.

10. An ion generator as defined in claim 1 wherein a plurality of driver and control electrodes form crossover locations in a matrix, and wherein a plurality of said air regions are defined by apertures in the control electrodes at said crossover locations.

11. An ion generator as defined in claim 1 further comprising a direct current potential between said control electrode and a further electrode to extract ions from said air region.

12. An ion generator as defined in claim 11 further comprising:

an apertured "screen" electrode;

a dielectric layer separating said screen electrode from the control electrode, said dielectric layer being apertured in coordination with the screen electrode to permit extraction of ions from said air region; and a screen potential between the screen electrode and a further electrode, to modulate the extraction of ions.

13. An ion generator, comprising:

a mica sheet;

a plurality of "driver" electrodes bonded to one face of said mica sheet;

a plurality of "control" electrodes bonded to an opposite face of said mica sheet and forming crossover locations with said driver electrodes, said control electrodes being apertured at said crossover locations to define air regions;

a time-varying potential between at least one of said driver electrodes and at least one of said control electrodes to form an ion producing glow discharge in the aperture at the crossover location of these electrodes, wherein said electrodes are bonded to said mica sheet with a thermoplastic adhesive of a thickness in the range 0.5 micron–5 microns.

14. An ion generator as defined in claim 13 wherein said thermoplastic adhesive is selected from the class consisting of organopolysiloxane adhesives and acrylic-based pressure sensitive adhesives.

15. An ion generator as defined in claim 14 wherein said thermoplastic adhesive comprises an alkyl aryl polysiloxane adhesive.

16. An ion generator as defined in claim 15 wherein said thermoplastic adhesive is selected from the class consisting of methyl phenyl and methyl polysiloxane adhesives.

17. An ion generator as defined in claim 13 further comprising a direct current potential between said control electrode and a further electrode to extract ions from said air region.

18. An ion generator as defined in claim 17 further comprising:

an apertured "screen" electrode;

a dielectric layer separating said screen electrode from the control electrodes, said dielectric layer being apertured in coordination with the screen electrode and the apertures of said control electrodes to permit said extraction of ions; and a screen potential between the screen electrode and a further electrode, to modulate the extraction of ions.

* * * * *